US008408114B1

(12) United States Patent
Tan

(10) Patent No.: US 8,408,114 B1
(45) Date of Patent: Apr. 2, 2013

(54) BALISTIC SHIELD

(75) Inventor: Seng Tan, Beavercreek, OH (US)

(73) Assignee: Wright Materials Research Co., Beavercreek, OH (US)

( * ) Notice: Subject to any disclaimer, the term of this patent is extended or adjusted under 35 U.S.C. 154(b) by 247 days.

(21) Appl. No.: 12/586,568

(22) Filed: Sep. 24, 2009

(51) Int. Cl.
*F41H 5/02* (2006.01)

(52) U.S. Cl. ..... 89/36.02; 102/200; 102/202.5; 102/202.7; 102/202.9; 102/202.14; 102/264

(58) Field of Classification Search ..... 89/36.01–36.17
See application file for complete search history.

(56) References Cited

U.S. PATENT DOCUMENTS 4,061,815 A * 12/1977 Poole, Jr. ..... 428/215
4,674,394 A * 6/1987 Martino ..... 89/36.05
5,039,567 A * 8/1991 Landi et al. ..... 428/116
5,392,686 A * 2/1995 Sankar ..... 89/36.05
5,534,343 A * 7/1996 Landi et al. ..... 428/313.5
5,641,934 A * 6/1997 Follett ..... 89/36.05
6,232,354 B1 * 5/2001 Tan ..... 521/60
6,367,943 B1 * 4/2002 Tocci et al. ..... 362/103
7,302,880 B1 * 12/2007 Elasic ..... 89/36.07
7,343,843 B2 * 3/2008 Sharpe et al. ..... 86/50
7,958,812 B2 * 6/2011 Wang et al. ..... 89/36.02
2007/0125224 A1 * 6/2007 Thomas ..... 89/36.07
2011/0005379 A1 * 1/2011 Wang et al. ..... 89/36.02
2011/0017053 A1 * 1/2011 Neal ..... 89/36.02

* cited by examiner

*Primary Examiner* — Samir Abdosh

(57) ABSTRACT

A ballistic shield for protection against up to 7.62×63 mm AP rounds (NIJ Level IV). The ballistic shield is multiple layered and includes polymer foam, ceramic tiles, and a support structure fabricated from ballistic resistant fabric. Individual layers are bonded with adhesives and preferably wrapped with fabric. Under the fabric cover of the exterior surface of the shield is a polymer foam layer that exhibits excellent blast impact resistance and blast attenuation properties as well as a hard ceramic or the like layer. The foam layer is preferably made from liquid crystal or semi-crystalline polymer to enhance fire resistance and provide enhanced ductility. According to a preferred embodiment, the man-portable ballistic shield of the present invention also incorporates a compact video system for viewing the front side of the ballistic shield thereby allowing for the elimination of the transparent view port weakness of current state of the art ballistic shields.

5 Claims, 3 Drawing Sheets

BALISTIC SHIELD

This invention was made with Government support under Contracts FA8650-04-C-5030 and HQ0006-07-C-7645 awarded by the U.S. Air Force and Missile Defense Agency. The Government has certain rights in the invention.

FIELD OF THE INVENTION

The present invention relates to ballistic shields and more particularly to such devices that are light enough to be readily man portable.

BACKGROUND OF THE INVENTION

Man portable ballistic shields are frequently used by SWAT teams, bomb squads, policemen, military agencies, and in civilian applications that may involve fragment impact due to operations related gun fire or explosions. Weight is a major consideration in the design of such portable shields. Most currently available ballistic shields are designed to defeat NIJ Level II and III rounds. Currently available ballistic shields for NIJ Level IV (7.62×63 mm AP (Armor Piercing)) protection are so heavy that they are mounted on wheels for mobility. In recent years, the availability of higher powered rifles and a variety of small caliber AP rounds has posed additional threats for law enforcement officers as well as the military. Thus, the need for ballistic shields providing NIJ Level IV protection has significantly increased. The is an even more pressing for the military because of the greatly increased availability of 7.62×63 mm AP weapons/rounds. This invention relates to the design and manufacturing of portable ballistic shields for weapons up to 7.62×63 mm AP protection. These new shields are much lighter in weight than the state-of-the-art shields. They also have some fire and blast protection capabilities.

Conventional portable shields are manufactured from metal sheets including but not limited to titanium, stainless steel, carbon steel, and superalloys. More modern ballistic shields are manufactured form ballistic resistant fabrics like aramid fibers and ceramic tiles.

Man-portable shields have been used since ancient times. Our ancestors used shields to protect from stone attacks. Later, shields were used for protection from arrows attack, swords, axes, spears, and other traditional weapons. Ballistic shields evolved with the invention of guns. Ballistic shield research and development, and improvements therein have evolved in parallel with the development of offensive weapons such as small arms. Man-portable ballistic shields for NIJ Level III protection appeared when rifles were developed. A state-of-the-art ballistic shield for NIJ Level III protection with dimensions of 20.5-in by 34.5-in weighs about 32-lb (for example those available from Protech). In recent years, the availability of armor piercing rounds has significantly altered and elevated the requirements for man-portable ballistic shields. Portable ballistic shields for protection against 7.62×63 mm AP rounds were developed because of this new demand.

Thus, the increased penetrating power of small arms drove the design of the ballistic shields to be thicker and heavier. In the early stages of this development, if metals were used to manufacture shields for protection against 7.62×63 mm AP rounds a medium size shield would weigh several hundred pounds. This weight severely affected the user's mobility and were basicaly unmanageable. The use of ceramic tiles significantly reduced the weight of the shield. The currently available Phoenix Level IV ballistic protection shield consists of 3 pieces of ceramic tile each 16×24-in and weighs 157 pounds. Based on the same construction a shield with an overall area 21×34-in weighs about 97-lb. This state-of-the-art ballistic shield is still very heavy and therefore, is mounted on wheels or dolly for mobility.

A typical ballistic man portable ballistic shield has a transparent window made of polycarbonate, see for example U.S. Pat. Nos. 7,302,880 B1 and 5,392,686. The view port is about 14.5 by 4.5-in and is fastened to the ballistic panel with screws through the front panel. Other designs use transparent polycarbonate for the entire shield, see U.S. Pat. No. 6,367,943 B1 and 5,641,934. For all these shields, a view port or an entire shield made from polycarbonate can only stop NIJ Level IIIA rounds. It is, therefore, a major weakness in the state-of-the-art NIJ Level IV ballistic shield. The shield described in U.S. Pat. No. 6,367,943 B1 uses a high-brightness light source to enhance visibility in darkness. While this improves visibility, it does not eliminate the basic problem of the relatively poor ballistic protection offered by the transparent polycarbonate window.

Thus, there remains a need for an enhanced lightweight, man portable ballistic shield that offers NIJ Level IV protection. To be considered "man portable" a ballistic shield should weigh less than about 75 pounds and preferably less than about 50 pounds.

OBJECTS OF THE INVENTION

It is therefore an object of the present invention to provide a lightweight man-portable ballistic shield offering NIJ Level IV protection.

It is another object of the present invention to provide such a ballistic shield that permits through shield viewing without the intentional introduction of a lower threat level weakness in the shield.

It is yet another object of the present invention to provide such a ballistic shield that permits through shield viewing in low light conditions without the intentional introduction of a lower threat level weakness in the shield.

SUMMARY OF THE INVENTION

According to the present invention, there is provided a relatively light weight man-portable ballistic shield for ballistic protection up to mainly 7.62×63 mm AP rounds (NIJ Level IV). The ballistic shield is multi-layered and includes polymer foam, ceramic tiles, and a support structure fabricated from ballistic resistant fabrics. Individual layers are bonded with adhesives and preferably wrapped with fabric. Under the fabric cover is a polymer foam layer that exhibits excellent blast impact resistance and blast attenuation properties. Although this foam layer can be manufactured from many kinds of polymers it is preferably made from liquid crystal or semi-crystalline polymer to enhance fire resistance and provide enhanced ductility. According to a preferred embodiment, the man-portable ballistic shield of the present invention also incorporates a compact video system for viewing the front side of the ballistic shield thereby allowing for the elimination of the transparent view port weakness of current state of the art ballistic shields.

DETAILED DESCRIPTION

Co-pending U.S. patent application Ser. No. 10/982,215, describes a polymer foam that can be fabricated using a net-shape or near net-shape process or in a block form followed by slicing it into thin sheet. When the net-shape or near net-shape process is used, gas saturated polymer powder or thin sheet is placed inside a mold and heated to its melting point. Under the pressure of the gas, the polymer expands to fill the mold and quickly becomes a net-shape foamed layer. Processing of a block foam is described in U.S. Pat. No. 6,232,354 B1. In this embodiment, the polymer powder or sheets are heated under pressure to form a consolidated panel. The consolidated panel is then foamed in a pressure vessel. An inert gas such as nitrogen or carbon dioxide is used as the foaming agent. After saturating the consolidated panel is pressurized with an inert fluid at an elevated temperature for a short period of time. Saturation with the inert fluid can be accomplished within 10 minutes to a few hours at elevated temperatures depending on the thickness of the part. The saturating fluid is then released quickly to ambient pressure. It is then controllably cooled down. This process creates micron size bubbles in the consolidated panel polymer matrix. No chemicals or solvents are needed for the foaming process. In the case of two-step process described in the foregoing U.S. Patent, the foam matrix is fabricated without fabrics. It is then sliced into thin sheets. Alternatively, this polymer foam layer can be purchased from a commercially available source. The ceramic layer can be manufactured in single or multiple pieces. It should exhibit a hard value of hardness. The multi-layered fabric of the support structure should have good ballistic resistant properties such as those demonstrated by aramid fabrics.

The second major component of the preferred ballistic shield of the present invention is a lightweight and compact video system that eliminates the transparent view port of current state of the art shields. The video system preferably comprises an LCD and a compact camera. The camera enables the user to see the other/front side of the shield in daytime and in darkness. The power source is a compact battery installed in the video enclosure.

The main objective of the instant invention is to provide a family of lightweight composite shields for ballistic protection. The ballistic shield of the present invention with an areal density of about 44-lb (including the video system) has the capability of defeating multiple hit of ballistic impact up to the 7.62×63 mm AP (NIJ Level IV) round. Currently available ballistic shields for NIJ Level IV protection weigh about two times more. The ballistic shield according to this invention also has some fire resistant and blast protection capability.

Figure 1:
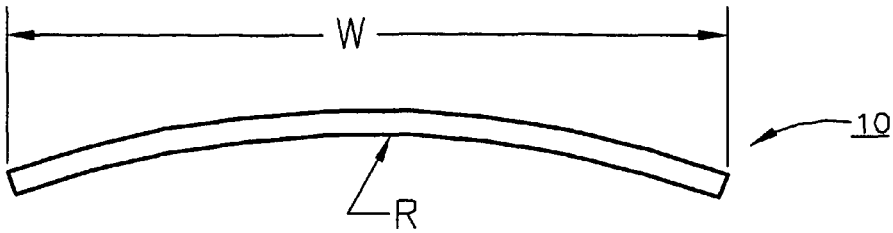
FIG. 1 is top plan view of the ballistic shield in accordance with the present invention.
Figure 2:
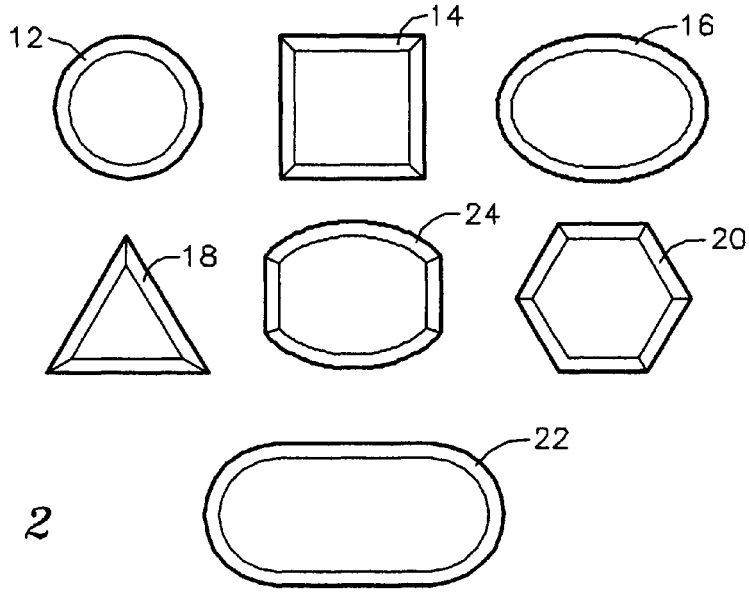
FIG. 2 shows a variety of enclosed shapes that can be used for the ballistic shield of the present invention.

Referring now to the accompanying drawings, FIG. 1 shows the top view of the ballistic shield 10 of the present invention. It has a radius of curvature R from infinity (flat plate) to a small dimension as 1-in. In the case of small radius of curvature the shield will have a tubular shape. In the case of other radii of curvature a complete structure could have a large cylindrical shape. Ballistic shields with various enclosed shapes, as shown in FIG. 2, have applications for protection of wires/cables, instruments, liquid, gases, and other important substances, structures or components. The ballistic shields with enclosed shapes may include but are not limited to circular 12, rectangular 14, elliptical 16, triangular 18, hexagonal 20, pentagonal, and any combination of different shapes like circular and straight 22 and 24 as depicted in FIG. 2.

Figure 3:
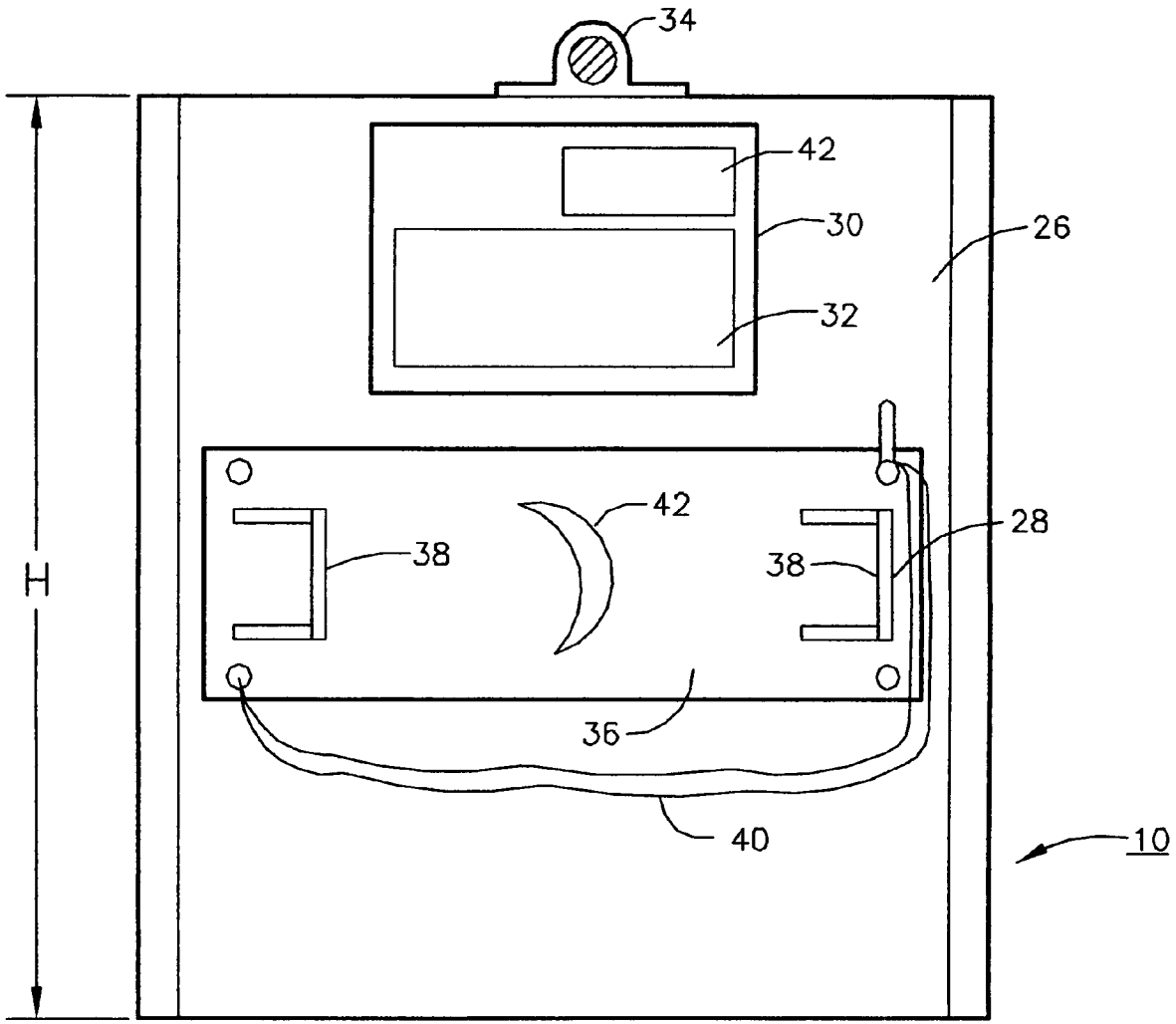
FIG. 3 is a rear view of the ballistic shield in accordance with the present invention.

In this invention, the ballistic shield for personnel protection can be manufactured in a flat shape (radius of curvature at infinity) or with a curvature. Referring again to the accompanying drawings, depicted in FIG. 1, is one preferred embodiment of the ballistic shield 10 of the present invention. W is the projected width of the shield. The radius of curvature R of ballistic shield 10 ranges from 10-in to infinity preferably between 15-in to infinity. A rear view of ballistic shield 10 is schematically shown in FIG. 3. H designates the height of ballistic shield 10. As depicted in FIG. 3, ballistic shield 10 in accordance with the present invention comprises a main body 26 made up of a metal sheet 28, an enclosure 30 for video display system 32, and a compact camera 34. A shield carrying plate (lightweight metal or plastic) 36 contains two handles 38 for right-handed and left-handed users. It also includes a shoulder strap 40 and forearm strap 42. The video system consists of an enclosure 30, a liquid crystal display (LCD) or similar viewing system 32, and a battery 42. Enclosure 30 can be made of a lightweight metal including, but not limited, to aluminum or a plastic sheet including, but not limited, to polycarbonate. A sheet of metal or plastic can be cut using a pattern and folded to become the enclosure. It can be attached to the main body 26 using hooks, adhesives, screws, or Velcro®.

Figure 4:
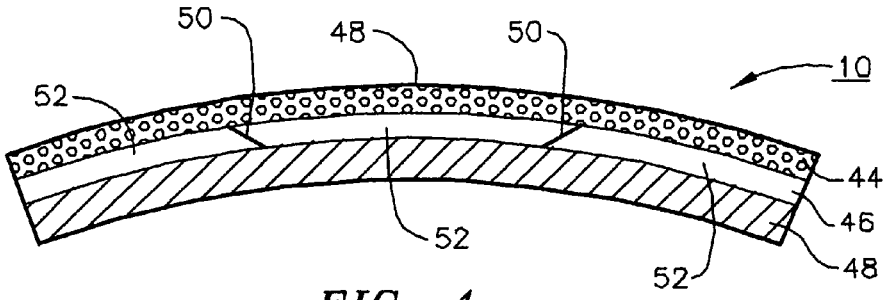
FIG. 4 is a schematic cross-sectional view of the ballistic shield in accordance with the present invention.

FIG. 4 depicts a cross sectional view of shield 10 as shown in FIG. 1. As shown in FIG. 4, ballistic shield 10 is of a multi-layered design. The outer layer 44 is a polymer foam. Underneath polymer foam layer 44 is a layer 46 of ceramic tiles. Ceramic tile layer 46 is supported by a composite structure 48 made from ballistic resistant fabrics. Ceramic layer 46 may comprise one or multiple pieces. A multiple-piece design can enhance the multiple hit capability of ballistic shield 10. The contact angle between adjacent ceramic plates (50 in FIG. 4) can be 90-degree or at a slanted angle. Since firearm attacks are most likely to approach from the front 48 of ballistic shield 10, it is better to design the contact angle in an off-axis angle, as shown at 50 in FIG. 4. The off-axis angle (from the plane direction) can range from 10 to 90-degree preferably from 30 to 90-degree. Laboratory tests of angular orientations indicate the reduction or elimination of the weakness of conventional joints that use a 90-degree of contact angle. A rifle bullet can penetrate the 90-degree joint but is stopped by the present design of off-axis contact angle.

Although the polymer foam can be manufactured from any suitable commercially available polymer, it is preferable to use from those that have excellent fracture toughness and fire retardant properties including but not limited to polycarbonate, liquid crystalline polymer (LCP), polyurethanes (PU), polyisocyanurate (PIR), elastomers, polyetheremide (PEI, e.g., Ultem), PMMA, crystalline and semi-crystalline polymers, shape memory polymers, polyesters, epoxies, polyimides etc. The polymer foam may be reinforced by chopped fibers, whiskers, ceramic powders, metal powders, various kinds of nano-fibers, various kinds of nano-tubes, nanowires, particles, etc. The reinforcement may serve to enhance the impact, fire resistant, thermal insulation, or other functional properties. The foam matrix is preferably characterized by cell diameters of from about 1 micron to about 3 mm. The pores of the polymeric foam can be either closed or open cell, preferably closed-cell. As an example, the polymer foam can be manufactured using the net-shape or near net-shape LCP foam described in the pending U.S. patent application Ser. Nos. 11/807,488 and 12/284,564. It can also be sliced from the LCP foam block prepared as described in U.S. Pat. No. 6,232,354 B1. Since the polymer foams layer are very ductile they can enhance the blast resistance properties of the ballistic shield. It can also prevent the ceramic layer 22 from damage due to handling, operations or fragment attack.

Ceramic plates 50 making up ceramic layer 46 can be chosen from a variety of ceramic plates exhibiting hardnesses over 1000 kg/mm$^2$. The thickness of the ceramic layer should be above 0.1-in. It can be manufactured in one or multiple pieces. In the case of a multiple-piece design shown in FIG. 4, the joining edges can be cut in 90-degree or a slanted angle. Alternatively, the ceramic layer may be replaced by a lightweight material with the same or higher value of hardness. These may include intermetallic, composites of metals and ceramics, nanocomposites, etc. The main purpose of this hard layer is to blunt the pointed tip of an incoming round or fragment. The support structure will then capture or stop the blunted bullet completely.

The support structure (composite) in this invention may consist of multiple layers of para-aramid fabrics like Kevlar®/Twaron®, ultra high molecular weight polyethylene (2,000,000 or more in molecular weight) fabrics like Spectra® and polybenzobisoxazole (PBO) fabrics. The number of layers of fabric used depends on the kind and thickness of the fabric as well as the threat to be overcome. It should preferably be between 10 and 100 layers. An appropriate design should be balance the properties of the ceramic tile and the support structure. For example, a thicker ceramic tile may use a thinner support structure. On the other hand, a thinner ceramic tile should use a thicker support structure. An appropriate ratio will achieve an optimal design of weight and ballistic resistant properties.

The polymer foam can be bonded to the ceramic layer by any adhesives including but not limited to 3M sprayed adhesive, elastomers, RTV, polyurethanes, epoxies, polyesters, shoe-goo, etc. These adhesives can also be used to bond the ceramic layer and the support structure.

The ballistic resistant structure of the present invention can, of course utilize other kinds of ballistic resistant fabrics, fabric with other patterns and designs, different stacking sequences, different thicknesses and number of fabric layers, variations in the hard layer (thickness, cutting angles, etc.), and foams with different densities or pore sizes. From the foregoing description and drawings, it will be apparent to the skilled artisan that many suitable arrangements of the polymer foam, layer(s) of hard material and the impact resistant fabrics for the support structure are to be considered as within the scope of the present invention.

Figure 5:
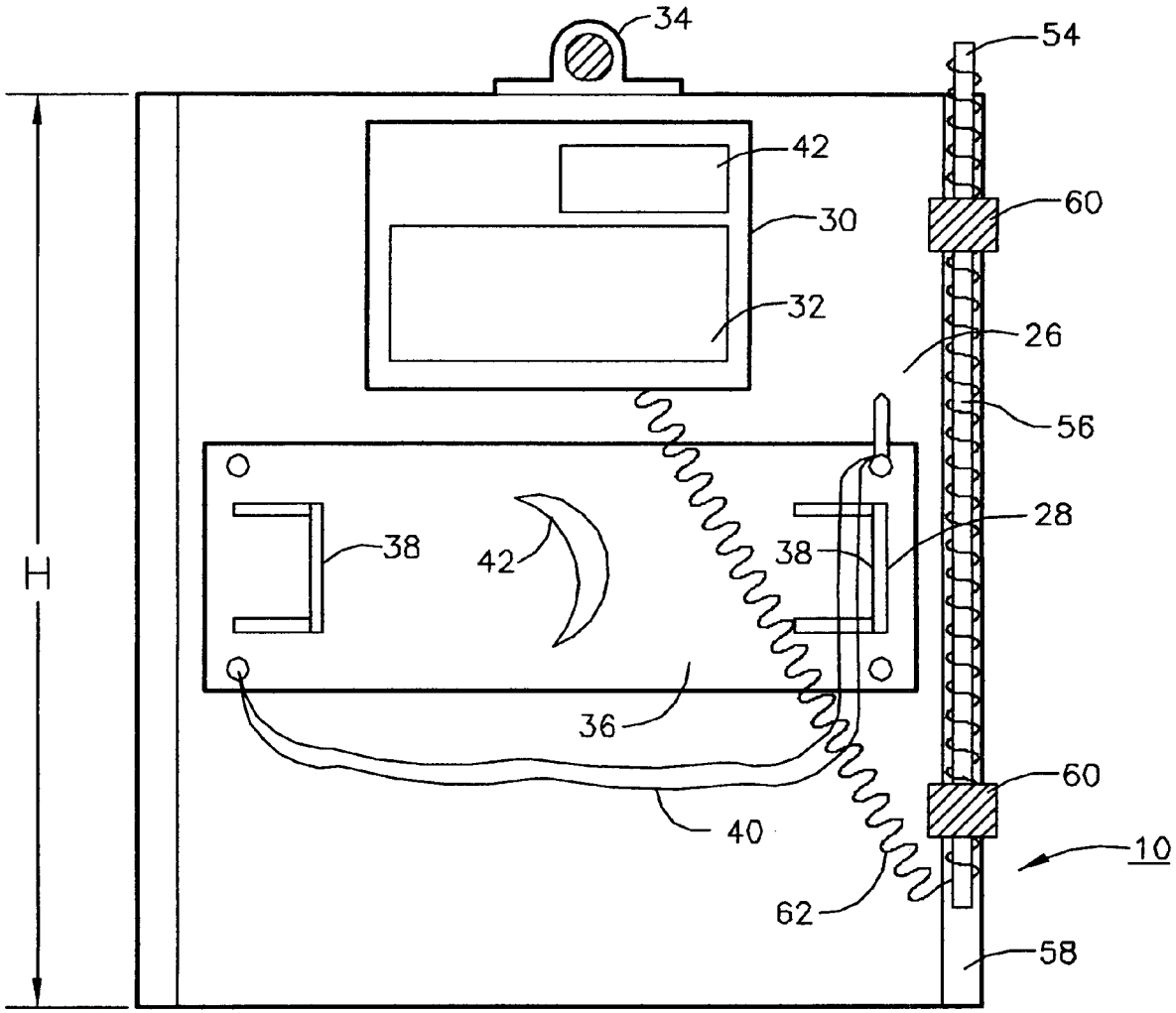
FIG. 5 is a rear view of the ballistic shield incorporating a compact camera and a camera-holding telescoping rod in accordance with a preferred embodiment of the present invention.

The ballistic shield's viewing capability can be enhanced by using high resolution liquid crystal displays (LCDs) or similar viewing devices, multiple cameras, and other similar techniques. As shown in FIG. 5, we have developed a design that enables a very broad viewing area. As shown in FIG. 5, a second very compact camera 54 is attached to the end of a lightweight telescoping rod 56. In its stowed position, telescoping rod 56 is attached to the edge 58 of the shield via clips or Velcro® 60. Telescoping stick 56, in its stowed position, is preferably shorter than the height H of ballistic shield 10 for convenience of utilization. Clips or Velcro® 60 allow the user to dismount and mount telescoping rod 56, i.e. extend telescoping rod 56 forward of the front surface of ballistic shield 10, using one hand. Camera 54 is connected to the LCD or other suitable display system 52 by a coiled wire 62. Such a viewing device offers several advantages to the man-portable shield 10. It enables user to: (1) see things over tens of feet high (several story building); (2) observe activities around corners without exposure of the users body; and (3) view activities through gaps or tiny spaces like under a door or through a window. The combination of telescoping rod 56 and compact camera 54 greatly enhances the user's viewing capability and reduces the risk of surprise attack. It also provides a secondary camera, in addition to camera 34, in case one camera is damaged. As will be apparent to the skilled artisan, cameras 34 and 54 may include infrared capabilities for viewing in low light and/or smoky conditions.

It should be understood that ballistic shield 10 may be mounted on a movable device or cart so that the user can have both hands free.

The following examples will serve to provide a better understanding of the structure and design of ballistic shield 10 in accordance with the present invention.

Example 1

Spectra Shield® was purchased from Honeywell (101 Columbia Road, Morristown, N.J. 07962). Kevlar®, and Twaron® fabrics were purchased from Barrday, Inc. (75 Moorefield St., P.O. Box 790, Cambridge, ON N1R 5W6) and Hexcel Schwebel (2200 South Murray Ave., Anderson, S.C. ). To fabricate the support structure with the single curvature as shown in FIGS. 1 and 3 we machined a closed mold from aluminum alloy. With a radius of curvature of 20-in and a projected width of 20-in the length of the curve is about 21-in. The height of the mold is 34-in. We first cut 28 layers of Spectra Shield and placed them into the mold. After closing the mold we heated the mold platens of a hydraulic press top to a temperature of between 120 and 150° C. and soaked for 10 to 60-min. The mold was then cooled down to a temperature somewhat below the molding point. The sample was removed from the mold. It has become a well-consolidated structure with a single curvature with a radius of curvature of 20-in. We repeated the molding cycle using 50 and 52 sheets of Spectra Shield® which produced well-consolidated and rigid structures. We then molded phenolic coated Twaron® fabrics and phenolic coated Kevlar® fabrics comprising between 20 and 45 sheets. All of these layered configurations produced consolidated and rigid structures.

Example 2

A Xydar® (LCP) foam block was manufactured according to the process described in a co-pending U.S. patent application Ser. No. 11/807,488. It was sliced into thin sheets between 0.125 and 0.25-in thick.

Silicon carbide tiles were purchased from CoorsTek (600 9$^{th}$ Street, P.O. Box 4025, Golden, Colo. 80401). Three pieces of SiC tiles were manufactured to make up the sizes (20-in projected width and 34-in height) and shape (radius of curvature of 20-in) as shown in FIGS. 1 and 3.

Using a Spectra Shield® support structure molded as described in EXAMPLE 1 we bonded the SiC tiles and the support structure with a room temperature cured adhesive. It was a Loctite® 60-min cure adhesive produced by Henkel Corporation was used for bonding. After 60-min or longer of cure time the SiC tiles and the Spectra Shield support structure became an integrated structure. The thin sheet of Xydar® foam mentioned above was then bonded to this structure using a sprayed adhesive manufactured by 3M. The foam was under light pressure during the curing of the sprayed adhesive. After holding for 20-min or longer the three components became an integrated structure. It was then wrapped up using a fabric. A fabric with foliage green color was used as it is the color designated for E-SAPI with NIJ Level IV protection. The 3M sprayed adhesive was used to bond the folded edges of the fabric. This completed the manufacturing of the main body of the ballistic shield.

Example 3

Two to eight holes were drilled along both sides of the support structure, prepared as described above, before it was bonded to the foam and ceramic plates. The holes were located near the center along the side of the shield. This allows the shield carrying plate 12 to be fastened at various locations and enable the user to conveniently cover the vital areas of his/her body according to his/her height. Tee nuts were installed at these holes. The shield carrying plate 12 is fastened to the shield using bolts through these holes with T nuts. This design does not create any holes in the hard layer and therefore eliminates all the weaknesses due to window and fastening that occur in the conventional ballistic shields.

Example 4

Camera enclosure 30 was manufactured from a thin, light-weight metal like aluminum alloy or plastics like polycarbonate. An aluminum alloy sheet about 0.125-in thick was cut and folded into the shape of the enclosure 30. The folded enclosure may have open sides that additional plates are needed to cover the sides through bonding or bolts. The manufacturing of the enclosure by a folding technique is only a convenient and cost-effective technique. It can be manufactured by cutting several pieces and bonding or fastening them together. The thickness of the sheet material for the construction of the enclosure can range between 0.01-in and 0.5-in. Obviously, a thinner material results in lighter weight. The dimensions of the LCD can range from 1 by 2-in to the width of the ballistic shield. It is preferably smaller than the width of the shield as a larger LCD increases the weight of the product.

Example 5

Flammability tests were performed using ASTM E 1354v Cone calorimeter tests at a radiant heat flux of 35 KW/m$^2$. The test results, Table 1, indicate that the weight losses of black PMMA, Kevlar/Xydar® foamed composite sandwich, PBO/Xydar® foamed composite sandwich and Xydar® (LCP) foam are 100%, 30.8%, 5.9%, and 46.4%, respectively. Apparently, the LCP foam used as the outer layer of the ballistic shield in this invention is superior to black PMMA and other polymer systems tested by FAA. During the entire test, the following properties were recorded and plotted: HRR (heat release rate per unit area), SPR (smoke production rate per unit area of exposed specimen), mass lost, $t_{ig}$ (time to ignition and sustained flaming over specimen surface for at least 10 sec), and $t_b$ (total burning duration—ignition to mass loss less than 150 g/m$^2$).

TABLE 1

LCP foam's fire resistant properties.

| Material | $t_{ig}$ (s) | $t_b$ (s) | $HRR_{peak}$ (kW/m$^2$) | $t_{peak}$ (s) | THR (MJ/m$^2$) | $HRR_{60S}$ (kW/m$^2$) | $HRR_{180S}$ (kW/m$^2$) |
|---|---|---|---|---|---|---|---|
| Black PMMA | 26 | 1154 | 715 | 880 | 727.6 | 345 | 526 |
| 0202.PB02 | 399 | 3450 | 95 | 770 | 180.3 | 7 | 33 |
| 0301.PB013 | 603 | 1574 | 29 | 1045 | 15.7 | 9 | 16 |
| 0302.LCP10 | 287 | 2052 | 84 | 305 | 78.7 | 63 | 48 |

| Material | $HRR_{300S}$ (kW/m$^2$) | $HRR_{30S,MAX}$ (kW/m$^2$) | 10-90 MLR (g/m$^2$-s) | Initial Mass (g) | Final Mass (g) | Mass Loss (g) | Mass Loss (%) |
|---|---|---|---|---|---|---|---|
| Black PMMA | 571 | | 27.8 | 307.8 | 0.2 | 307.7 | 100 |
| 0202.PB02 | 48 | 94 | 2.3 | 226.4 | 154.1 | 69.7 | 30.8 |
| 0301.PB013 | 18 | 28 | 0.9 | 198.4 | 183.1 | 11.7 | 5.9 |
| 0302.LCP10 | 46 | 76 | 1.7 | 64.7 | 33.8 | 30 | 46.4 |

| Material | EHC (MJ/kg) | SEA (m$^2$/kg) | SPR (1/s) | $SR_1$ (m$^2$/m$^2$) | $SR_2$ (m$^2$/m$^2$) | TSR (m$^2$/m$^2$) |
|---|---|---|---|---|---|---|
| Black PMMA | 23.7 | 90 | | | | |
| 0202.PB02 | 22.9 | 189 | 0.41 | 98 | 1493 | 1591 |
| 0301.PB013 | 11.8 | 54 | 0.08 | 110 | 72 | 182 |
| 0302.LCP10 | 23.2 | 127 | 0.22 | 96 | 430 | 525 |

0202.PBO2: Kevlar ®/Xydar ® foamed composite sandwich
0301.PBO13: PBO /Xydar ® foamed composite sandwich
0302.LCP10: Xydar ® (LCP) foam Example 6

We manufactured a ballistic shield with dimensions of 20-in wide (21-in measured along the curvature) by 34-in height according to the procedures and materials mentioned above. The LCP foam layer was manufactured from Xydar® based on the technique disclosed in a co-pending U.S. patent application Ser. No. 11/807,488 SiC plates were purchased from CoorsTek as a special custom made item. The edges of the SiC plates have a 45-degree bevel as shown in FIG. 4. Three SiC plates were used to make the ballistic shield that has a radius of curvature of 20-in. A support structure was molded from Spectra Shield® according to EXAMPLE 1. These components were bonded using 3M sprayed adhesive and 60-min cured Loctite® adhesive. The thus formed composite was then wrapped with a foliage green color fabric and bonded with a sprayed adhesive. The completed shield weighed 44-lb. The ballistic shield was tested by ICS Laboratories Inc. (1072 Industrial Parkway North, Brunswick, Ohio 44212) based on the standard NIJ 0108.01 type IV. It was tested with 7.62×63 mm AP M2 (NIJ Level IV) rounds at an average of 2880 fps (feet per second). ICS certified that the thus produced shield had a multiple hit capability of up to 3 shoots. Three more ballistic shields were subsequently manufactured and shipped to ICS to determine the V50 of this model using 7.62×63 mm AP M2 (NIJ Level IV) rounds. ICS determined that the V50 of this model was 3095 fps.

Example 7

A ballistic shield was manufactured using 53 layers of Twaron® fabrics and a thin layer of Xydar® foam. It has an areal density of about 7 psf. A ballistic shield manufactured according to this example demonstrated that it can defeat multiple hits of AK47 FMJ delivered at 2400 fps. When a thin layer of SiC plate was used, the number of layers of the Twaron® fabrics. The shield had an areal density of about 6.9 psf. It can defeat multiple hit of AK47 FMJ delivered at 2400 fps.

Example 8

A ballistic shield was molded from Spectra Shield® and bonded to a Xydar® foam at the exterior surface. It was then wrapped with a fabric with foliage green color. This shield has dimensions of 21 (along curvature) by 34-in. and weighs about 13.5-lb. Ballistic tests showed that it can defeat various kinds of hand guns, fragments, and AK47 hollow point rounds.

This shield meets the UL752 level 7 and NIJ Level III standards. This design has potential application for firefighter and policeman for riot control. These applications may involve hand guns, small rifle like AK47, fragment impact, fire and smoke. Our infrared camera system allows user to see things in smoky and dark environments.

There have thus been described portable ballistic shields that exhibit the following capabilities:

1. ability to defeat NIJ Level IV 7.62×63 mm AP rounds in multiple hits;
2. lightweight (over 120% lighter than state-of-the-art ballistic shields);
3. different viewing options to fit customer's own needs;
4. eliminates the viewing port weaknesses of conventional man-portable protective shields;
5. enables user to see things in the dark without using a bright light;
6. fire retardant; and
7. some blast protection capability.

As the invention has been described, it will be apparent to those skilled in the art that the same may be varied in many ways without departing from the spirit and scope of the invention. Any and all such modifications are intended to be included within the scope of the appended claims.

The invention claimed is:

1. A man-portable ballistic shield having a front and a rear surface comprising:

A) a multi-layer supporting structure comprising a plurality of ballistic resistant fabric layers;

B) a hard ballistic resistant layer exhibiting a hardness of at least 1000 kg/mm$^2$, C) a polymer foam layer;

D) a telescoping rod that can be extended beyond the front surface of the ballistic shield to provide extended viewing in front of the ballistic shield attached to said shield; and E) a camera attached to said telescoping rod providing a view at least forward of the front surface.

2. The ballistic shield of claim 1, wherein the telescoping rod is removeably attached to the ballistic shield.

3. The ballistic shield of claim 1 further comprising a display at the rear of the ballistic shield allowing for viewing of images from said camera by a user.

4. A ballistic shield having a front and a rear surface comprising, in order from the rear surface:

A) a composite layer comprising one or more ballistic resistant fabric layers;

B) a ceramic layer;

C) a polymer foam layer;

said ballistic shield being man portable and further including a viewing system comprising a telescoping rod attached to said shield; and a camera mounted on said telescoping rod providing a view at least forward of the front surface and a display at the rear of the ballistic shield allowing for viewing by a user.

5. A ballistic shield having a front and rear surface comprising, in order from rear surface:

A) a composite layer comprising one or more ballistic resistant fabric layers;

B) a ceramic layer; said ceramic layer comprising at least two ceramic plates arranged end to end and joined at an off-axis contact angle;

wherein said ceramic layer comprises a first ceramic plate and a second ceramic plate; said first plate and said second plate each having at least one slanted end so as to align with at least one slanted end of a neighboring ceramic plate; the angle of said at least one slanted end of said first plate and the angle said at least one slanted end of said second plate being complimentary angles so as to form a uniform ceramic layer;

said ceramic layer having a front surface corresponding with said front surface of said ballistic shield and a rear surface corresponding with said rear surface of said ballistic shield;

said ceramic plates have a long side and a short side; and said front surface of said ceramic layer is formed solely by said long side of said ceramic plates; and C) a polymer foam layer.

* * * * *